US010388264B2

(12) United States Patent
Sugano

(10) Patent No.: US 10,388,264 B2
(45) Date of Patent: Aug. 20, 2019

(54) AUDIO SIGNAL PROCESSING APPARATUS, AUDIO SIGNAL PROCESSING METHOD, AND AUDIO SIGNAL PROCESSING PROGRAM

(71) Applicant: JVC KENWOOD Corporation, Yokohama-shi, Kanagawa (JP)

(72) Inventor: Masato Sugano, Yokohama (JP)

(73) Assignee: JVC KENWOOD CORPORATION, Yokohama-shi, Kanagawa (JP)

( * ) Notice: Subject to any disclaimer, the term of this patent is extended or adjusted under 35 U.S.C. 154(b) by 0 days.

(21) Appl. No.: 15/814,875

(22) Filed: Nov. 16, 2017

(65) Prior Publication Data

US 2018/0075833 A1 Mar. 15, 2018

Related U.S. Application Data

(63) Continuation of application No. PCT/JP2016/056204, filed on Mar. 1, 2016.

(30) Foreign Application Priority Data

May 18, 2015 (JP) ..... 2015-100661

(51) Int. Cl.
*G10K 11/175* (2006.01)
*G10L 21/0208* (2013.01)
(Continued)

(52) U.S. Cl.
CPC ..... *G10K 11/175* (2013.01); *G10L 21/0208* (2013.01); *G10L 21/0232* (2013.01); *G10L 2021/02163* (2013.01)

(58) Field of Classification Search
None
See application file for complete search history.

(56) References Cited

U.S. PATENT DOCUMENTS 5,157,760 A * 10/1992 Akagiri ..... G06T 9/007 704/227
5,485,524 A * 1/1996 Kuusama ..... G10L 21/0208 333/14
(Continued)

FOREIGN PATENT DOCUMENTS

JP 2001-134287 A 5/2001
JP 2002-140100 A 5/2002
(Continued)

OTHER PUBLICATIONS

Written Opinion of the International Searching Authority (PCT/ISA/237 form ) dated May 17, 2017 in corresponding International Application No. PCT/JP2016/056204.

*Primary Examiner* — Qin Zhu
(74) *Attorney, Agent, or Firm* — Nath, Goldberg & Meyer; Jerald L. Meyer

(57) ABSTRACT

A frequency domain converter divides an input signal for each predetermined frame, and generates a first signal X(f, τ) for each first frequency division unit. A noise estimation signal generator generates a signal Y(f, τ) for each second frequency division unit wider than the first frequency division unit. A signal comparator calculates a representative value for each second frequency division unit based on the signal Y(f, τ) stored in a storage unit, and compares the representative value and the signal Y(f, τ) with each other for each second frequency division unit. A mask generator generates a mask M(f, τ), which determines a degree of suppression or emphasis for each first frequency division unit, based on a peak range of the signal X(f, τ), and a comparison result by the signal comparator. The mask application unit multiplies the signal X(f, τ) by the mask M(f, τ).

5 Claims, 6 Drawing Sheets

(51) Int. Cl.
*G10L 21/0232* (2013.01)
*G10L 21/0216* (2013.01)

(56) References Cited

U.S. PATENT DOCUMENTS 5,839,101 A * 11/1998 Vahatalo ..... G10L 21/0208
704/217
2010/0158263 A1* 6/2010 Katzer ..... G10K 11/175
381/73.1
2011/0026724 A1* 2/2011 Doclo ..... G10K 11/178
381/71.8

FOREIGN PATENT DOCUMENTS

JP 2006-126859 A 5/2005
JP 2008-116686 A 5/2008

* cited by examiner

AUDIO SIGNAL PROCESSING APPARATUS, AUDIO SIGNAL PROCESSING METHOD, AND AUDIO SIGNAL PROCESSING PROGRAM

CROSS REFERENCE TO RELATED APPLICATION

This application is a Continuation of PCT Application No. PCT/JP2016/056204, filed on Mar. 1, 2016, and claims the priority of Japanese Patent Application No. 2015-100661 filed on May 18, 2015, the entire contents of both of which are incorporated herein by reference.

BACKGROUND

The present disclosure relates to an audio signal processing apparatus, an audio signal processing method, and an audio signal processing program, which suppress noise.

A variety of techniques for suppressing a noise signal mixed in an audio signal have been proposed for the purpose of enhancing transmission quality and recognition accuracy of the audio signal. Examples of the conventional noise suppression techniques include the spectral subtraction (SS) method and the comb filter (comb-shaped filter) method.

However, in the spectral subtraction method, noise is suppressed only by noise information without using sound information, and accordingly, there have been problems of deterioration in the sound signal, and the occurrence of tone noise called musical noise. Moreover, in the comb filter method, there has been a problem that when an error occurs in a pitch frequency, then the sound signal is suppressed, or the noise signal is emphasized.

Japanese Unexamined Patent Application Publication No. 2006-126859 (Patent Literature 1) describes a sound processing apparatus that solves the problems of the spectral subtraction method and the comb filter method.

First, the sound processing apparatus described in Patent Literature 1 calculates a spectrum by frequency-dividing an input signal for each frame, and estimates a noise spectrum based on the spectra of a plurality of the frames. Then, based on the estimated noise spectrum and the spectrum of the input signal, the sound processing apparatus described in Patent Literature 1 identifies whether the input signal is a sound component or a noise component for each frequency division unit of the input signal.

Next, the sound processing apparatus described in Patent Literature 1 generates a coefficient for emphasizing a frequency division unit identified as a sound component and a coefficient for suppressing a frequency division unit identified as a noise component. Then, the sound processing apparatus described in Patent Literature 1 multiplies the input signal by the coefficient for each of these frequency division units, and obtains a noise suppression effect.

SUMMARY

However, the sound processing apparatus described in Patent Literature 1 has sometimes failed to obtain sufficient accuracy in either noise spectrum estimation accuracy or identification accuracy between the sound component and the noise component. This is because the noise spectrum estimation and the identification between the sound component and the noise component for each frequency division unit are performed based on a spectrum with the same frequency division width.

In order to suppress the influence of a sudden noise component, it is desirable that the noise spectrum estimation be performed based on a spectrum with a certain frequency division width (for example, approximately several hundred to several thousand Hz). Meanwhile, the identification between the sound component and the noise component requires accurate sound pitch detection, and accordingly, it is desirable that the identification concerned be performed based on a spectrum with a narrower frequency division width (for example, approximately several ten Hz) than that of the noise spectrum estimation.

Hence, in the sound processing apparatus described in Patent Literature 1, the sound has sometimes been deteriorated, and the noise suppression has been insufficient.

A first aspect of the embodiments provides an audio signal processing apparatus including: a frequency domain converter configured to divide an input signal for each predetermined frame, and to generate a first signal that is a signal for each first frequency division unit; a noise estimation signal generator configured to generate a second signal that is a signal for each second frequency division unit wider than the first frequency division unit; a peak range detector configured to obtain a peak range of the first signal; a storage unit configured to store the second signal; a signal comparator configured to calculate a representative value for each second frequency division unit based on the second signal stored in the storage unit, and to compare the representative value and the second signal with each other for each second frequency division unit; a mask generator configured to generate a mask based on the peak range and a comparison result by the signal comparator, the mask determining a degree of suppression or emphasis for each first frequency division unit; and a mask application unit configured to multiply the first signal by the mask generated by the mask generator.

A second aspect of the embodiments provides an audio signal processing method including: dividing an input signal for each predetermined frame and generating a first signal that is a signal for each first frequency division unit; generating a second signal that is a signal for each second frequency division unit wider than the first frequency division unit; obtaining a peak range of the first signal; storing the second signal in a storage unit; calculating a representative value for each second frequency division unit based on the second signal stored in the storage unit and comparing the representative value and the second signal with each other for each second frequency division unit; generating a mask based on the peak range and a comparison result between the representative value and the second signal, the mask determining a degree of suppression or emphasis for each first frequency division unit; and multiplying the first signal by the generated mask.

A third aspect of the embodiments provides an audio signal processing program stored in a non-transitory storage medium, the audio signal processing program causing a computer to execute: a frequency domain conversion step of dividing an input signal for each predetermined frame and generating a first signal that is a signal for each first frequency division unit; a noise estimation signal generation step of generating a second signal that is a signal for each second frequency division unit wider than the first frequency division unit; a peak range detection step of obtaining a peak range of the first signal; a storage step of storing the second signal in a storage unit; a signal comparison step of calculating a representative value for each second frequency division unit based on the second signal stored in the storage unit and comparing the representative value and the second signal with each other for each second frequency division unit; a mask generation step of generating a mask based on the peak range and a comparison result between the representative value and the second signal, the mask determining a degree of suppression or emphasis for each first frequency division unit; and a mask application step of multiplying the first signal by the mask generated in the mask generation step.

DETAILED DESCRIPTION

Embodiment 1

Figure 1:
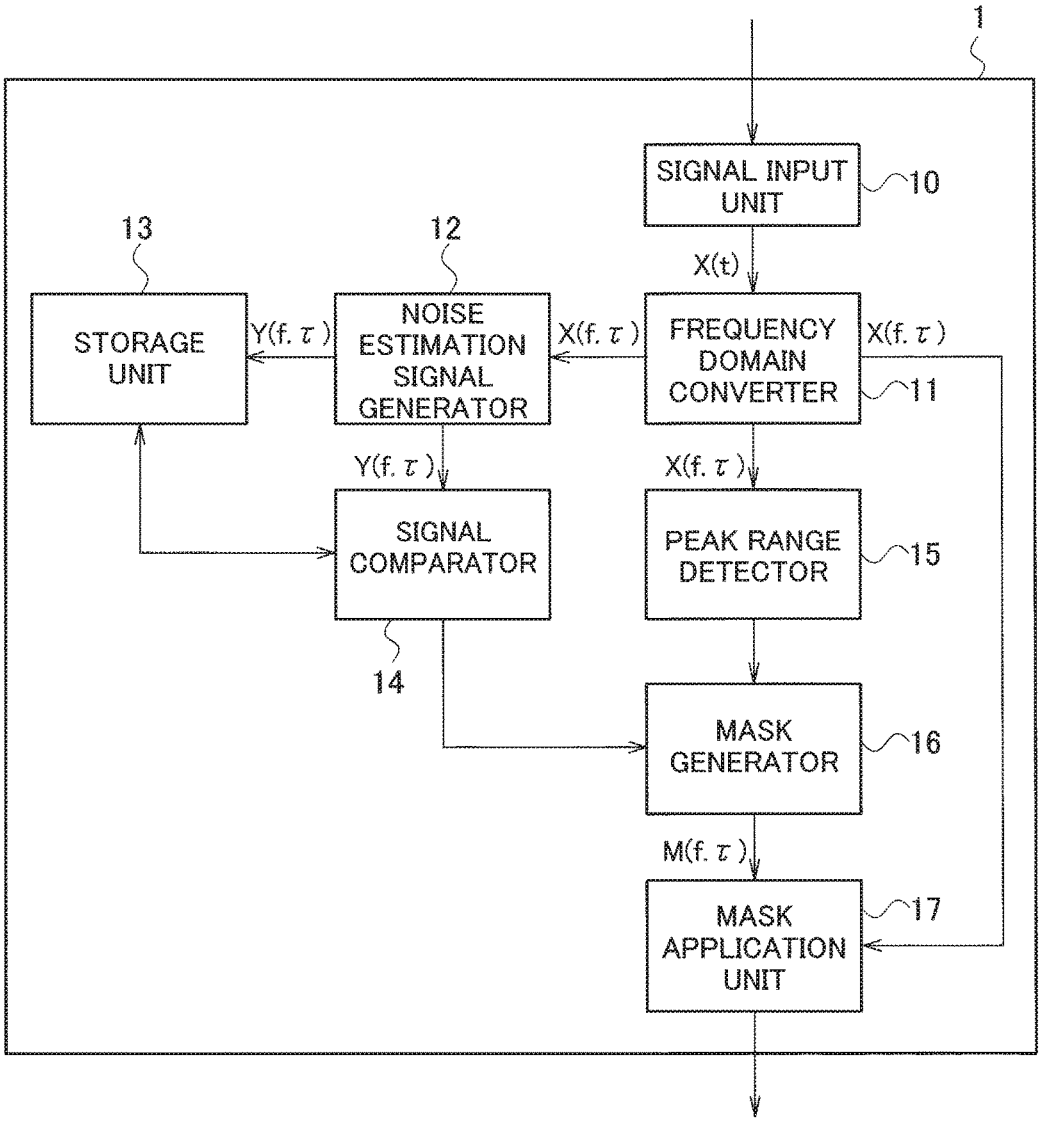
FIG. 1 is a block diagram showing an audio signal processing apparatus according to Embodiment 1.

Hereinafter, a description will be made of Embodiment 1 with reference to the drawings. FIG. 1 shows a block diagram of an audio signal processing apparatus 1 according to Embodiment 1. The audio signal processing apparatus 1 according to Embodiment 1 includes a signal input unit 10, a frequency domain converter 11, a noise estimation signal generator 12, a storage unit 13, a signal comparator 14, a peak range detector 15, a mask generator 16, and a mask application unit 17.

The signal input unit 10 and the storage unit 13 are composed of hardware. Moreover, the frequency domain converter 11, the noise estimation signal generator 12, the signal comparator 14, the peak range detector 15, the mask generator 16, and the mask application unit 17 are realized by an audio signal processing program executed by a computing unit such as a CPU or a DSP. In this case, the audio signal processing program is stored in a variety of computer readable media, and is supplied to the computer. The respective constituent elements realized by the program may be composed of hardware.

The signal input unit 10 acquires an audio input signal from a sound acquisition unit (not shown). Then, the signal input unit 10 converts the audio input signal thus inputted into a digital signal x(t). t indicates a time. Note that when the inputted audio input signal is already a digital value, it is not necessary to have a configuration for converting the audio input signal into a digital signal.

The frequency domain converter 11 converts the signal x(t), which is inputted from the signal input unit 10, into a frequency domain signal X(f, τ). f indicates a frequency, and τ indicates a frame number. The signal X(f, τ) is a first signal. The frequency domain converter 11 divides the signal x(t) by a window function with a predetermined frame length, implements conversion processing to a frequency domain, such as the FFT, for each divided frame, and thereby generates a signal X(f, τ) in the frequency domain. The frequency domain converter 11 supplies the generated signal X(f, τ) to the noise estimation signal generator 12, the peak range detector 15, and the mask application unit 17.

The noise estimation signal generator 12 groups the signal X(f, τ), which is generated by the frequency domain converter 11, for each predetermined frequency division unit, and generates a noise estimation signal Y(f, τ) divided by a frequency division width wider than the frequency division unit of the signal X(f, τ). Specifically, the noise estimation signal generator 12 calculates an amplitude value a(f, τ) or a power value S (f, τ) from the signal X(f, τ), and for each signal within a predetermined frequency range, obtains a sum and average value of these values. The noise estimation signal Y(f, τ) is a second signal.

Figure 2:
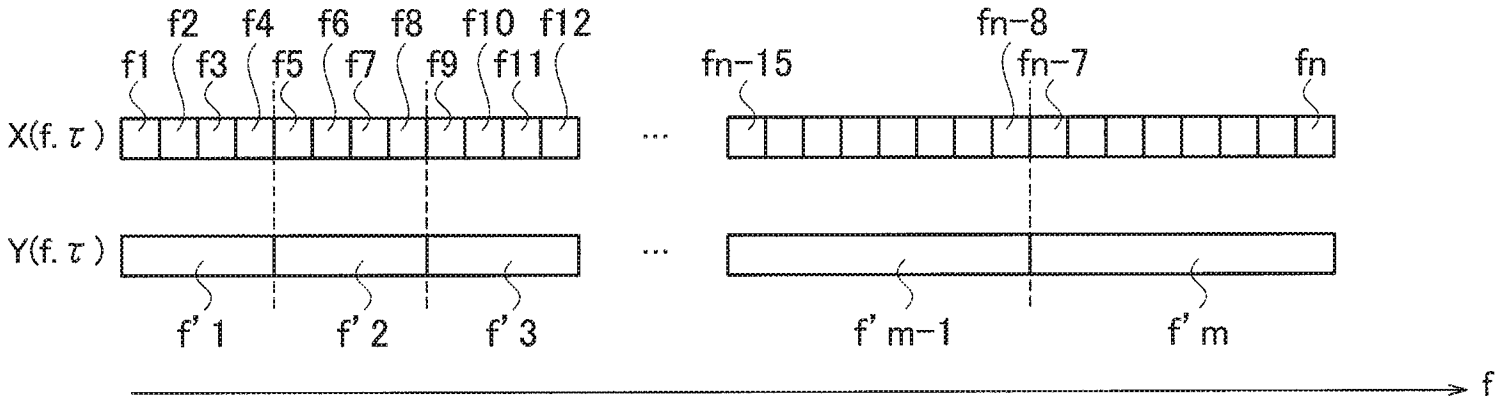
FIG. 2 is a schematic diagram showing a relationship between a signal X(f, τ) and a noise estimation signal Y(f, τ) in a frequency domain.

FIG. 2 schematically shows a relationship between X(f, τ) and Y(f, τ). Each of the blocks represents a signal component for each frequency division unit. n is a frequency division number of X(f, τ), and m is a frequency division number of Y(f, τ).

A frequency division unit f'1 of Y(f, τ), which is shown in FIG. 2, is generated based on frequency division units fl to f4 of X(f, τ), which are shown in FIG. 2. In a similar way, the frequency division units f'2, f'3 . . . , f'm−1 and f'm are divided into frequency division units f5 to f8, f9 to f12 . . . , fn−15 to fn−8, and fn−7 to fn. As will be described later, the frequency division width may be varied depending on the frequency band. In FIG. 2, the frequency division unit f'1 and the frequency division unit f'm are caused to have frequency division widths different from each other, for example.

The noise estimation signal generator 12 supplies the generated noise estimation signal Y(f, τ) to the storage unit 13 and the signal comparator 14. The frequency domain converter 11 may directly generate the noise estimation signal Y(f, τ) from the signal x(t). In this case, the frequency domain converter 11 also operates as a noise estimation signal generator, and the noise estimation signal generator 12 separate from the frequency domain converter 11 is not required.

Here, a description will be made of a reason why the noise estimation signal generator 12 generates the noise estimation signal Y(f, τ) with a frequency division width wider than that of X(f, τ). When a sudden noise signal, particularly a tone noise signal, is inputted to the signal input unit 10, then with a frequency division width of approximately several ten Hz, a ratio occupied by a noise signal component in the frequency division unit increases as compared with the frequency division width of approximately several hundred to several thousand Hz. In this case, in a determination process of the signal comparator 14, which will be described later, there increases a probability of erroneously determining that the noise is a sound.

Meanwhile, in the peak range detector 15 which will be described later, it is necessary that each frequency component that composes the sound accurately appear as a peak. Hence, it is desirable that the frequency domain converter 11 generate the signal X(f, τ) with a frequency division width of approximately several ten Hz.

As described above, the processing in the signal comparator 14 and the processing in the peak range detector 15 are different from each other in desirable frequency division width. Hence, the noise estimation signal generator 12 generates the noise estimation signal Y(f, τ) with a wider frequency division width as compared with when the frequency domain converter 11 generates the signal X(f, τ).

It is desirable that the noise estimation signal generator 12 generate the noise estimation signal Y(f, τ) with the following frequency division widths in the respective frequency bands. The respective frequency division widths are: approximately 100 Hz to 300 Hz in a frequency domain of less than 1 kHz; approximately 300 Hz to 500 Hz in a frequency domain of 1 kHz or more to less than 2 kHz; and approximately 1 kHz to 2 kHz in a frequency domain of 2 kHz or more.

The storage unit 13 stores the noise estimation signal Y(f, τ) generated by the noise estimation signal generator 12. Specifically, the storage unit 13 stores a frequency division unit that is determined as noise without satisfying a predetermined condition in the determination by the signal comparator 14, which will be described later. Meanwhile, the storage unit 13 does not store such a frequency division unit, which satisfies the predetermined condition, and is determined as a sound. It is desirable that a time length of the signal stored in the storage unit 13 be approximately 50 to 200 ms.

Note that the storage unit 13 may store all the frequency division units and all the determination results of the signal comparator 14, and the signal comparator 14 may calculate a representative value V(f) which will be described later, based on such frequency division units determined as noise.

Based on the noise estimation signal stored in the storage unit 13, the signal comparator 14 calculates the representative value V(f) such as an average value, a median value, or a mode value for each frequency division unit. The noise estimation signal Y(f, τ) indicates a noise estimation signal of a latest frame. In a similar way, Y(f, τ−1) indicates a noise estimation signal of a frame one frame before the latest frame, and Y(f, τ−2) indicates a noise estimation signal of a frame two frames before the latest frame. The signal comparator 14 calculates an average value, which uses the three frames, by using, for example, the following Equation (1).

$$V(f)=Y(f,\tau)+Y(f,\tau-1)+Y(f,\tau-2)/3 \quad (1)$$

The signal comparator 14 may calculate a simple average, which equivalently treats the signals of the respective frames, as the representative value V(f) as shown in Equation (1). Moreover, the signal comparator 14 may calculate the representative value V(f) by weighting frames closer to the present as shown in the following Equation (2).

$$V(f)=0.5\times Y(f,\tau)+0.3\times Y(f,\tau-1)+0.2Y(f,\tau-2) \quad (2)$$

Here, the storage unit 13 may store the representative value V(f) calculated by the signal comparator 14 instead of storing the past noise estimation signals. In this case, the signal comparator 14 calculates a new representative value V(f) by using Equation (3), and stores the calculated representative value V(f) in the storage unit 13. Here, α is a value that satisfies $0<\alpha<1$.

$$V(f)=\alpha\times V(f)+(1-a)\times Y(f,\tau) \quad (3)$$

Next, the signal comparator 14 compares the calculated representative value V(f) and the noise estimation signal Y(f, τ) with each other, and determines whether or not the predetermined condition is satisfied. Specifically, the signal comparator 14 obtains a comparison value such as a difference and a ratio between the representative value V(f) and the noise estimation signal Y(f, τ), and determines whether or not the comparison value stays within a predetermined range.

As described above, the signal comparator 14 calculates the representative value V(f) based on the frequency division unit determined as noise among the past noise estimation signals Y(f, τ). Hence, it is highly probable that the frequency component of the sound signal may be included in such a noise estimation signal Y(f, τ) exhibiting a prominent value by comparison with the representative value V(f).

Here, amplitude values of the noise are different between a low frequency domain and a high frequency domain, and accordingly, it is desirable that the predetermined condition for use in comparing the representative value V(f) and the noise estimation signal Y(f, τ) with each other be set for each frequency band. Hence, when the ratio of Y(f, τ)/V (f) is used for comparison, a range where the ratio is 2 to 3 or more becomes such a desirable predetermined condition in a frequency band of less than 1 kHz, and a range where the ratio is 1 to 2 or more becomes such a desirable predetermined condition in a frequency band of 1 kHz or more.

After the comparison determination processing is completed, the peak range detector 15 obtains a peak frequency range by using a spectrum of the signal X(f, τ).

Figure 3A:
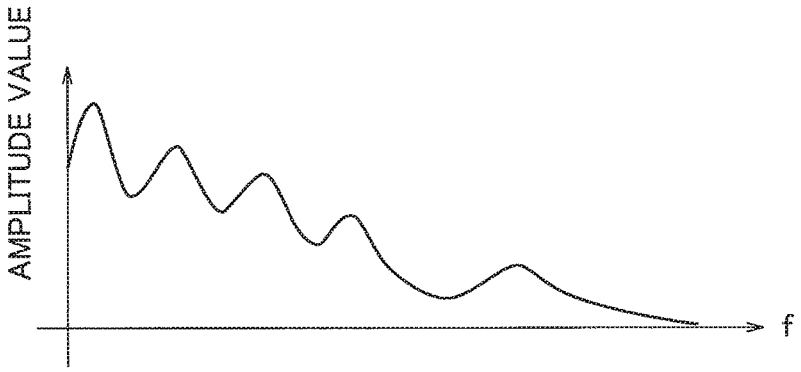
FIGS. 3A to 3C are frequency distribution diagrams schematically showing a spectrum of the signal X(f, τ) in the frequency domain.
Figure 3B:
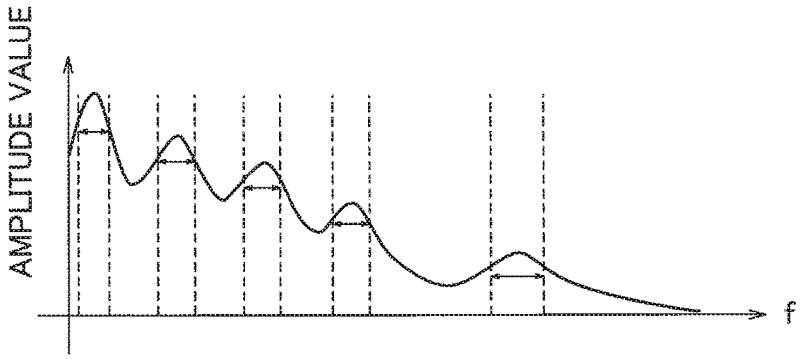

FIG. 3A is a frequency distribution diagram schematically showing the spectrum of the signal X(f, τ) including the sound. An amplitude value of the frequency component of the sound signal exhibits a larger amplitude value than those of other frequency components. Hence, the peak frequency range of the signal X(f, τ) is detected, whereby the frequency component of the sound signal is obtained. Each of the frequency ranges in arrow sections in FIG. 3B shows the peak frequency range.

Next, a specific example is illustrated where the peak range detector 15 detects the peak frequency range. First, the peak range detector 15 calculates a differential value in the frequency axis direction of the signal X(f, τ) in the frequency domain, which is generated by the frequency domain converter 11. Such a range where the differential value exhibits a predetermined inclination is calculated, whereby the peak frequency range that is an upward convex range is obtained.

Figure 3C:
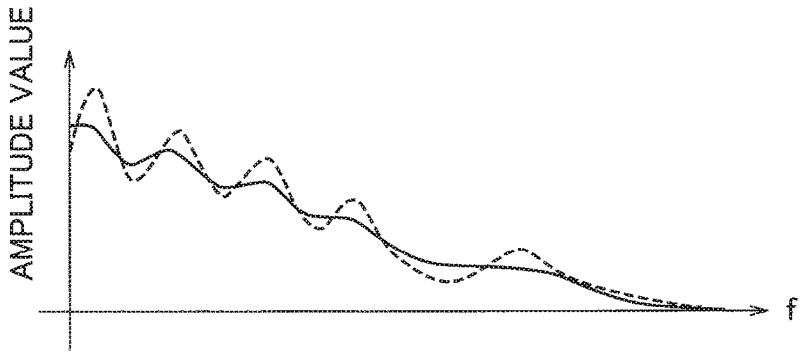

Moreover, the peak range detector 15 may apply a low-pass filter to the spectrum to smooth the spectrum concerned, may calculate a frequency range where a difference or a ratio between the original spectrum and the smoothed spectrum falls within a predetermined range, and may obtain the peak frequency range. In a frequency distribution diagram shown in FIG. 3C, a broken line schematically shows the original spectrum of the signal X(f, τ), and a solid line schematically shows the smoothed spectrum. In this example, ranges where a value of the broken line is larger than a value of the solid lines when points where the solid line and the broken line intersect each other are defined as boundaries can be obtained as the peak frequency.

Here, a peak kurtosis is different between the low frequency domain and the high frequency domain, and accordingly, the peak range detector 15 may change a determination method for each certain frequency domain. For example, when such a differential value is used, the range of the inclination only needs to be changed for each frequency domain. Moreover, when the comparison is made with the smoothed spectrum, a degree of smoothing only needs to be changed for each frequency domain, or the smoothed spectrum only needs to be moved in parallel. As described above, the calculation of the peak frequency range is not limited to the above-described method, and other methods may be adopted.

Based on the determination result (comparison result) by the signal comparator 14 and the peak frequency range detected by the peak range detector 15, the mask generator 16 generates a mask M(f, τ) that suppresses or emphasizes each frequency component of the signal X(f, τ).

Specifically, the mask generator 16 generates a mask M(f, τ), which defines, as such a frequency component to be emphasized, the frequency component determined as a sound in the signal comparator 14 and detected as a peak range in the peak range detector 15, and defines other frequency components as such frequency components to be suppressed.

Here, for degrees of the emphasis and the suppression in each frequency component, there are: a method of dynamically determining these from the representative value V(f); and a method of previously determining emphasis and suppression values corresponding to the representative value V(f). In the former case, the mask generator 16 only needs to compare a noise-free spectrum and the representative value V(f) with each other, and to calculate a suppression coefficient for suppressing each frequency component to a level corresponding to the noise-free spectrum. In the latter case, the mask generator 16 only needs to predefine a table of suppression coefficients, and to select a suppression coefficient corresponding to the representative value V(f) from the table.

The mask application unit 17 multiplies the signal X(f, τ) by the mask M(f, τ) generated by the mask generator 16. The signal X(f, τ) is multiplied by the mask M(f, τ), whereby the frequency component of the noise included in the signal X(f, τ) is suppressed, and the frequency component of the sound included therein is emphasized. The mask application unit 17 outputs the suppressed or emphasized signal X(f, τ).

Figure 4:
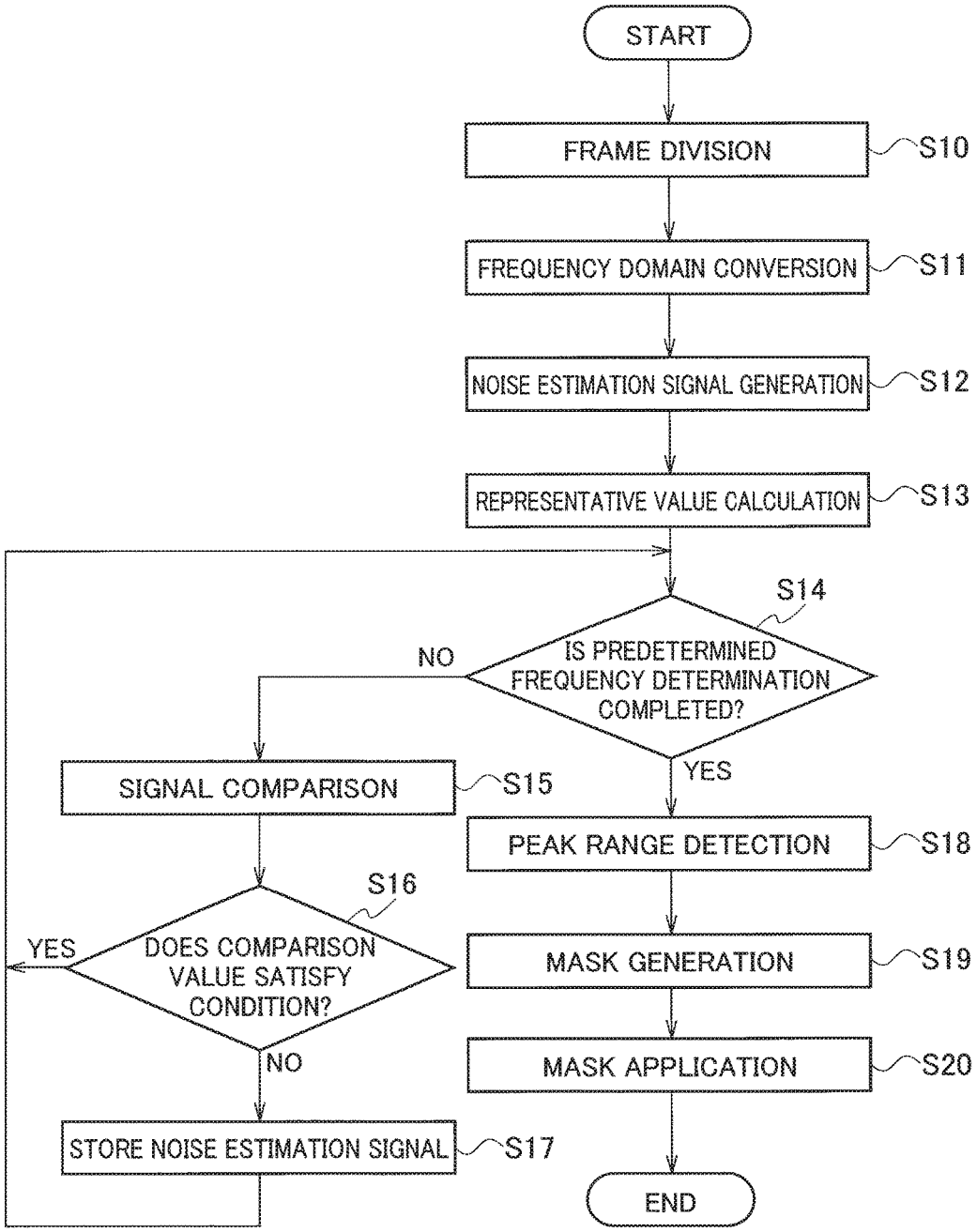
FIG. 4 is a flowchart showing a process in the audio signal processing apparatus according to Embodiment 1, and showing a procedure which an audio signal processing method and an audio signal processing program cause a computer to execute.

Next, referring to FIG. 4, a description will be made of an operation of the audio signal processing apparatus 1 of Embodiment 1. The operation to be described below is similarly applied to a procedure executed by the audio signal processing method and the audio signal processing program.

When the processing of the audio signal is started, then in step S10, the frequency domain converter 11 divides the signal x(t), which is inputted from the signal input unit 10, by a window function with a predetermined frame length.

Next, in step S11, for each divided frame, the frequency domain converter 11 implements the conversion processing to the frequency domain, such as the FFT, and generates the signal X(f, τ) in the frequency domain. The frequency domain converter 11 supplies the generated signal X(f, τ) to the noise estimation signal generator 12, the peak range detector 15, and the mask application unit 17.

In step S12, the noise estimation signal generator 12 generates the noise estimation signal Y(f, τ) from the signal X(f, τ).

In step S13, based on the noise estimation signal stored in the storage unit 13, the signal comparator 14 calculates the representative value V(f) for each frequency division unit.

In step S14, the signal comparator 14 determines whether or not each of the processing steps from step S15 to step S17 is completed for all of the frequency division units in the predetermined frequency range. When the above-described processing is completed (step S14: YES), the signal comparator 14 shifts the processing to step S18. When the above-described processing is not completed (step S14: NO), the signal comparator 14 shifts the processing to step S15.

In step S15, the signal comparator 14 calculates the comparison value such as the difference and the ratio between the representative value V(f) and the noise estimation signal Y(f, τ).

In step S16, the signal comparator 14 determines whether or not the comparison value satisfies the predetermined condition. When the comparison value satisfies the predetermined condition (step S16: YES), the signal comparator 14 returns the processing to step S14. When the comparison value does not satisfy the predetermined condition (step S16: NO), the signal comparator 14 shifts the processing to step S17.

In step S17, the storage unit 13 stores the noise estimation signal Y(f, τ).

In step S18, the peak range detector 15 obtains the peak frequency range by using the spectrum of the signal X(f, τ).

In step S19, based on the result of the signal comparator 14 and the peak frequency range detected by the peak range detector 15, the mask generator 16 generates the mask M(f, τ) that suppresses or emphasizes each frequency component of the signal X(f, τ).

In step S20, the mask application unit 17 multiplies the signal X(f, τ) by the mask M(f, τ) generated by the mask generator 16. The processing of the audio signal is thus completed.

By the above-described processing, the sound or the noise in each frequency component can be determined with high accuracy, accordingly, the deterioration of the sound can be reduced, and the noise can be sufficiently suppressed.

Embodiment 2

Figure 5:
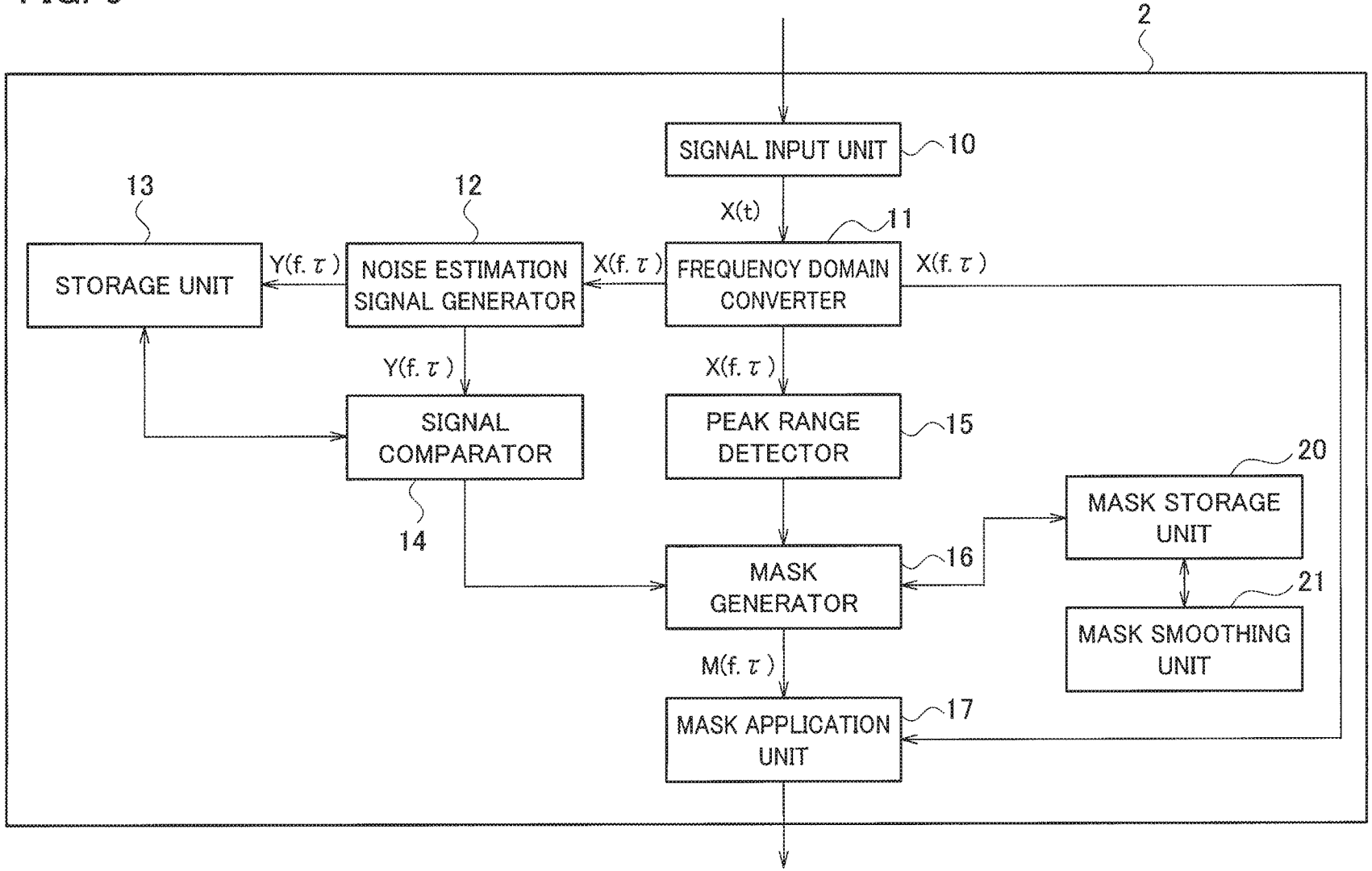
FIG. 5 is a block diagram showing an audio signal processing apparatus according to Embodiment 2.

Hereinafter, a description will be made of Embodiment 2 with reference to the drawing. FIG. 5 shows a block diagram of an audio signal processing apparatus 2 according to Embodiment 2. The audio signal processing apparatus 2 of Embodiment 2 includes a mask storage unit 20 and a mask smoothing unit 21 in addition to the constituents of the audio signal processing apparatus 1 of Embodiment 1. Hence, a description of common constituents will be omitted.

The mask storage unit 20 stores such masks M(f, τ), which are generated by the mask generator 16, by a predetermined number of frames. In Embodiment 2, it is desirable that the mask storage unit 20 store the masks with a number of frames for approximately 100 ms. The mask storage unit 20 discards past masks, of which the number exceeds the predetermined number of frames, and sequentially stores new masks.

The mask smoothing unit 21 smoothes the mask M (f, τ) using the masks stored in the mask storage unit 20. Specifically, the mask smoothing unit 21 convolves a smoothing filter such as a two-dimensional Gaussian filter with the masks arrayed in time series, and thereby smoothes the mask M(f, τ), and generate a smoothing mask. The mask application unit 17 multiplies the signal X(f, τ) by the smoothing mask.

Figure 6:
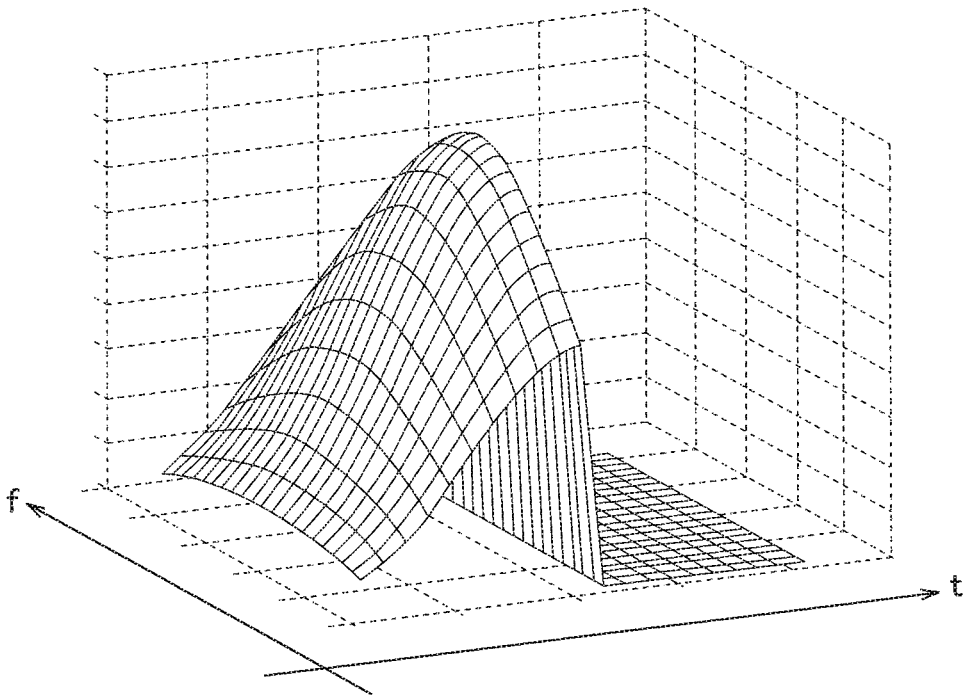
FIG. 6 is a diagram showing an example of a two-dimensional filter for mask smoothing.

FIG. 6 shows an example of a smoothing filter. The smoothing filter shown in FIG. 6 is configured such that coefficients thereof are smaller for past frames, and that the coefficients thereof are larger for frequency components closer to the frequency components to be smoothed.

Moreover, in the real-time processing, coefficients which are later in a time series cannot be convolved, and accordingly, the smoothing filter shown in FIG. 6 sets, to 0, all the coefficients in frames after the current frame.

By the above-described processing, the emphasis or the suppression is performed by using the masks with the coefficients smoothly continuous in the time axis direction and the frequency axis direction, and accordingly, such processing in which both the noise suppression and the natural sound are simultaneously achieved can be realized.

The audio signal processing apparatuses, audio signal processing methods, and audio signal processing programs of Embodiments 1 and 2 can be used for any electronic instrument that handles an audio signal including a sound component.

What is claimed is:

1. An audio signal processing apparatus comprising:

a frequency domain converter configured to divide an input signal for each predetermined frame, and to generate a first signal that is a signal for each first frequency division unit;

a noise estimation signal generator configured to generate a second signal that is a signal for each second frequency division unit wider than the first frequency division unit;

a peak range detector configured to obtain a peak range of the first signal;

a storage unit configured to store the second signal;

a signal comparator configured to calculate a representative value for each second frequency division unit based on the second signal stored in the storage unit, and to compare the representative value and the second signal with each other for each second frequency division unit;

a mask generator configured to generate a mask based on the peak range and a comparison result by the signal comparator, the mask determining a degree of suppression or emphasis for each first frequency division unit; and a mask application unit configured to multiply the first signal by the mask generated by the mask generator.

2. The audio signal processing apparatus according to claim 1, wherein the noise estimation signal generator is configured to group the first signal for each predetermined frequency division unit, and to generate the second signal.

3. The audio signal processing apparatus according to claim 1, further comprising:

a mask storage unit configured to store the mask; and a mask smoothing unit configured to generate a smoothing mask by using a predetermined smoothing filter based on a plurality of the masks stored in the mask storage unit, wherein the mask application unit is configured to multiply the first signal by the smoothing mask as the mask.

4. An audio signal processing method comprising:

dividing an input signal for each predetermined frame and generating a first signal that is a signal for each first frequency division unit;

generating a second signal that is a signal for each second frequency division unit wider than the first frequency division unit;

obtaining a peak range of the first signal;

storing the second signal in a storage unit;

calculating a representative value for each second frequency division unit based on the second signal stored in the storage unit and comparing the representative value and the second signal with each other for each second frequency division unit;

generating a mask based on the peak range and a comparison result between the representative value and the second signal, the mask determining a degree of suppression or emphasis for each first frequency division unit; and multiplying the first signal by the generated mask.

5. A computer product that includes a non-transitory storage medium readable by a processor, the non-transitory storage medium having stored thereon a set of instructions for performing audio signal processing, the instructions comprising:

(a) a first set of instructions which, when loaded into main memory and executed by the processor, causes the processor to initiate a frequency domain conversion, wherein the frequency domain conversion comprises dividing an input signal for each of a set of predetermined frames and generating a first signal that is a signal for each of a set of first frequency division units, wherein the frequency domain conversion is performed by a frequency domain converter;

(b) a second set of instructions which, when loaded into main memory and executed by the processor, causes the processor to initiate a noise estimation signal generation, wherein the noise estimation signal generation comprises generating a second signal that is a signal for each of a set of second frequency division units wider than the first frequency division unit, wherein the noise estimation signal generation is performed by a noise estimation signal generator;

(c) a third set of instructions which, when loaded into main memory and executed by the processor, causes the processor to initiate a-peak range detection, wherein the peak range detection comprises obtaining a peak range of the first signal, wherein the peak range detection is performed by a peak range detector;

(d) a fourth set of instructions which, when loaded into main memory and executed by the processor, causes the processor to initiate a storage, wherein the storage comprises storing the second signal in a storage unit;

(e) a fifth set of instructions which, when loaded into main memory and executed by the processor, causes the processor to initiate a signal comparison, wherein the signal comparison comprises calculating a representative value for each said second frequency division unit based on the second signal stored in the storage unit and comparing the representative value and the second signal with each other for each said second frequency division unit, wherein the signal comparison is performed by a signal comparator;

(f) a sixth set of instructions which, when loaded into main memory and executed by the processor, causes the processor to initiate a mask generation, wherein the mask generation comprises generating a mask based on the peak range and a comparison result between the representative value and the second signal, the mask determining a degree of suppression or emphasis for each said first frequency division unit, wherein the mask generation is performed by a mask generator; and (g) a seventh set of instructions which, when loaded into main memory and executed by the processor, causes the processor to initiate a mask application, wherein the mask application comprises multiplying the first signal by the mask generated in the sixth set of instructions, wherein the mask application is performed by a mask application unit.

* * * * *